US008079811B1

(12) United States Patent
Liang

(10) Patent No.: US 8,079,811 B1
(45) Date of Patent: Dec. 20, 2011

(54) TURBINE BLADE WITH MULTI-IMPINGEMENT COOLED SQUEALER TIP

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 1002 days.

(21) Appl. No.: 12/018,344

(22) Filed: Jan. 23, 2008

(51) Int. Cl.
*F01D 5/18* (2006.01)

(52) U.S. Cl. ..... 416/97 R

(58) Field of Classification Search ..... 416/92, 416/97 R; 415/115
See application file for complete search history.

(56) References Cited

U.S. PATENT DOCUMENTS 6,254,346 B1 * 7/2001 Fukuno et al. ..... 416/97 R
6,932,571 B2 * 8/2005 Cunha et al. ..... 416/97 R
6,971,851 B2 * 12/2005 Liang ..... 416/1
7,632,062 B2 * 12/2009 Harvey et al. ..... 415/115
* cited by examiner

*Primary Examiner* — Ninh H Nguyen
(74) *Attorney, Agent, or Firm* — John Ryznic

(57) ABSTRACT

A turbine blade with a squealer tip having a cooling circuit formed from a number of rows of multiple impingement cavities that extend across the blade tip from the pressure side wall to the suction side wall. One of the impingement cavities (main impingement cavity) in each row is connected to a cooling pressure supply channel through a main metering and impingement hole. The remaining impingement cavities in the row is either a pressure side impingement cavity or a suction side impingement cavity, and each are connected to the main impingement cavity through secondary metering and impingement holes. The impingement cavities located on the ends and adjacent to the side walls of the blade tip are connected top film cooling holes. Cooling air from the supply channel flows through the main metering and impingement holes and into the main impingement cavities, then flows into the pressure side impingement cavity or cavities through the secondary metering and impingement holes or through the pressure side impingement cavities through the secondary metering and impingement holes. At the last cavity adjacent to the walls, the cooling air flows through the film cooling holes to discharge from the blade tip.

9 Claims, 3 Drawing Sheets

View A-A

View B-B

TURBINE BLADE WITH MULTI-IMPINGEMENT COOLED SQUEALER TIP

BACKGROUND OF THE INVENTION

1. Field of the Invention

The present invention relates generally to a gas turbine engine, and more specifically to a turbine blade with a cooled squealer tip.

2. Description of the Related Art Including Information Disclosed Under 37 CFR 1.97 and 1.98

In a gas turbine engine, a hot gas flow is developed in the combustor from the burning of a fuel with compressed air from the compressor and then passed through a multiple staged turbine to produce mechanical power. In an aero engine, the mechanical power drives the rotor shaft that is connected to a bypass fan. In an industrial gas turbine engine, the rotor shaft is connected to an electric generator that will produce electrical power. In both engines, the engine efficiency can be increased by passing a higher temperature gas into the turbine. However, the turbine inlet temperature is limited to the material properties of the first stage turbine airfoils, these airfoils being the stator vanes and the rotor blades.

Complex internal airfoil cooling passages have been proposed, to provide high levels of airfoil cooling using a minimal amount of cooling air. Higher turbine inlet temperatures are obtainable by providing improved airfoil cooling. Also, since the compressed air used to cool these airfoils is taken from the compressor, the use of a minimal amount of compressor bleed off air for the airfoil cooling will also increase the engine efficiency.

Airfoil cooling is also important in increasing the life of the airfoils. Hot spots can, occur on sections of the airfoils that are not adequately cooled. These hot spots can cause oxidation that will lead to shortened life for the airfoil. Blade tips are especially subject to hot spots since it is nearly impossible to total eliminate the gap between the rotating blade tip and the stationary shroud that forms the gap. Without any gas, blade tip rubbing will occur which leads to other problems. Because of the presence of the tip gap, the hot gas can flow through the gap and expose the blade tip surface to the extreme high temperatures of the gas flow. Therefore, adequate blade tip cooling is also required to reduce hot gas flow leakage and to control metal temperature in order to increase part life.

In the prior art, an airfoil tip edge is cooled by using multiple film cooling holes. FIG. 1 shows a prior art blade tip region with a row of film cooling holes just below the tip edge on the suction side. FIG. 3 shows a row of film cooling holes on the pressure side. FIG. 2 shows a prior art turbine blade. These film cooling holes are fed from the blade internal cavity and exit at various gas side discharge pressures along the blade tip peripheral. As a result of this cooling approach, cooling flow distribution and pressure ratio across these film cooling holes for the pressure side and the suction side film cooling holes are predetermined by the internal cavity pressure. In addition, the blade tip region is also subject to severe secondary flow field which requires a large number of film cooling holes and a large amount of cooling flow to cool the blade tip periphery.

BRIEF SUMMARY OF THE INVENTION

The problem associated with a turbine airfoil tip edge cooling can be eliminated or reduced by the use of the new and effective cooling geometry of the present invention into the prior art turbine airfoil in the tip section cooling design. The present invention is a multi-impingement cooling circuit for a blade squealer tip section. The multi-impingement cooling circuit can be constructed in a small module formation along the blade tip periphery. Individual modules can be designed based on the pressure gradient across the blade squealer tip, especially for the pressure differential between the airfoil pressure side versus the suction side. The individual modules can also be designed based on the gas side discharge pressure along the blade tip periphery for a desired coolant flow distribution as well as designed based on the squealer tip local external heat load to achieve a desired local metal temperature requirement.

DETAILED DESCRIPTION OF THE INVENTION

Figure 1:
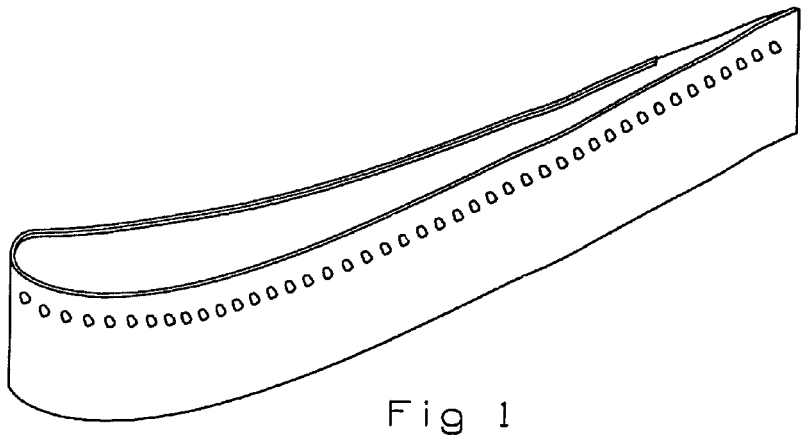
Fig 1 Prior Art
FIG. 1 shows a prior art turbine blade tip with a row of film cooling holes on the suction side.
Figure 2:
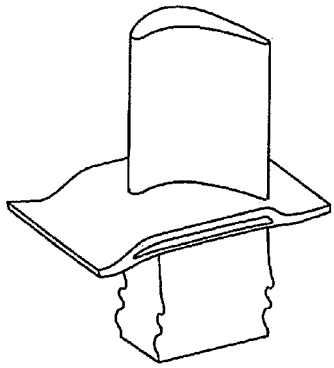
Fig 2 Prior Art
FIG. 2 shows a prior art turbine blade.
Figure 3:
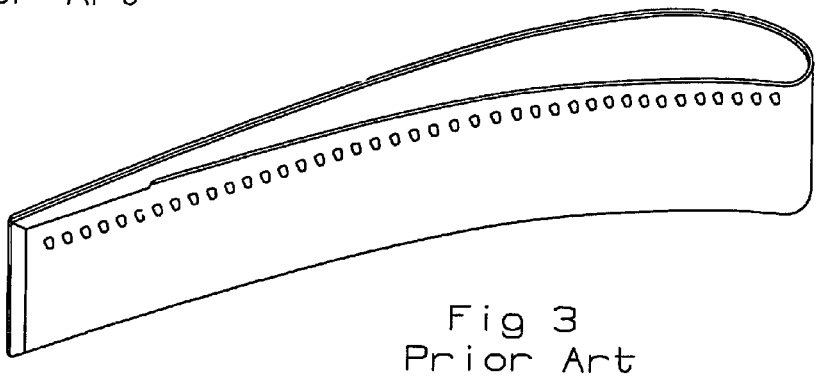
Fig 3 Prior Art
FIG. 3 shows a prior art turbine blade tip with a row of film cooling holes on the pressure side.
Figure 4:
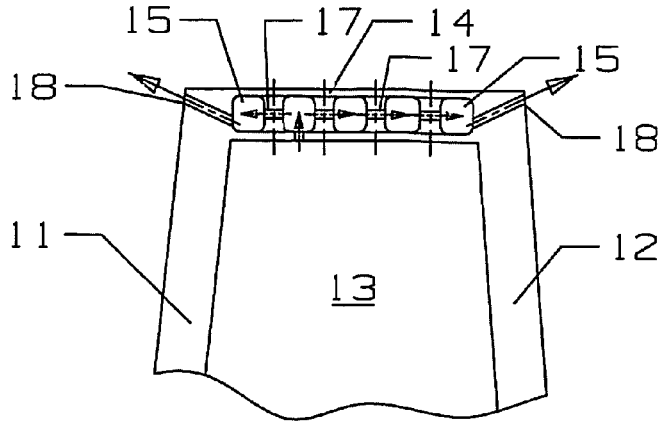
FIG. 4 shows side cross section view of the blade tip cooling circuit of the present invention.
Figure 5:
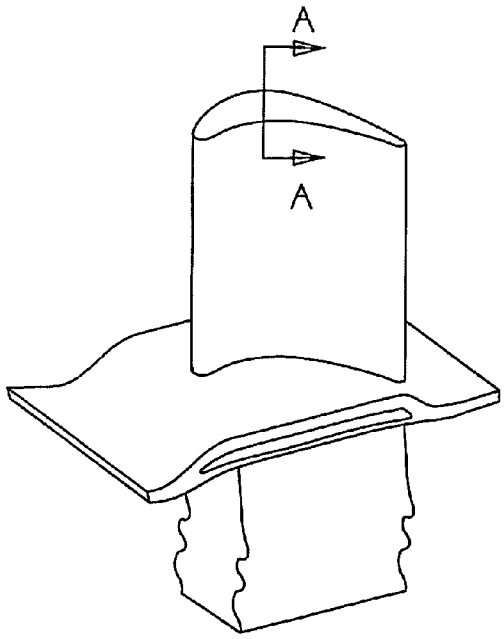
FIG. 5 shows a turbine blade with a cut indicating the view of FIG. 4 on the blade tip.

The present invention is a blade tip cooling circuit that can be incorporated into the prior art turbine blades. FIG. 4 shows a cross section view of the blade tip as represented by the arrows in FIG. 5. The blade tip includes a pressure side wall 11 and a suction side wall 12 with an internal cooling passage 13 formed between the two walls. Pressurized cooling air is supplied to the internal cooling passage from the external source.

The blade tip includes a plurality of impingement cavities 15 extending across the tip just below the blade tip surface 14. A main impingement cooling hole 16 connects the internal cooling passage 13 to one of the impingement cavities 15. In FIG. 4, the main impingement cooling hole 16 is connected to the second impingement cavity from the pressure side wall. This forms one pressure side impingement cavity and three suction side impingement cavities located between the walls and the cavity connected to the internal cooling passage 13.

Adjacent impingement cavities 15 are connected by impingement holes 17. The impingement cavities adjacent to the airfoil walls are connected by film cooling holes 18 to the external surface of the blade tip periphery.

Figure 6:
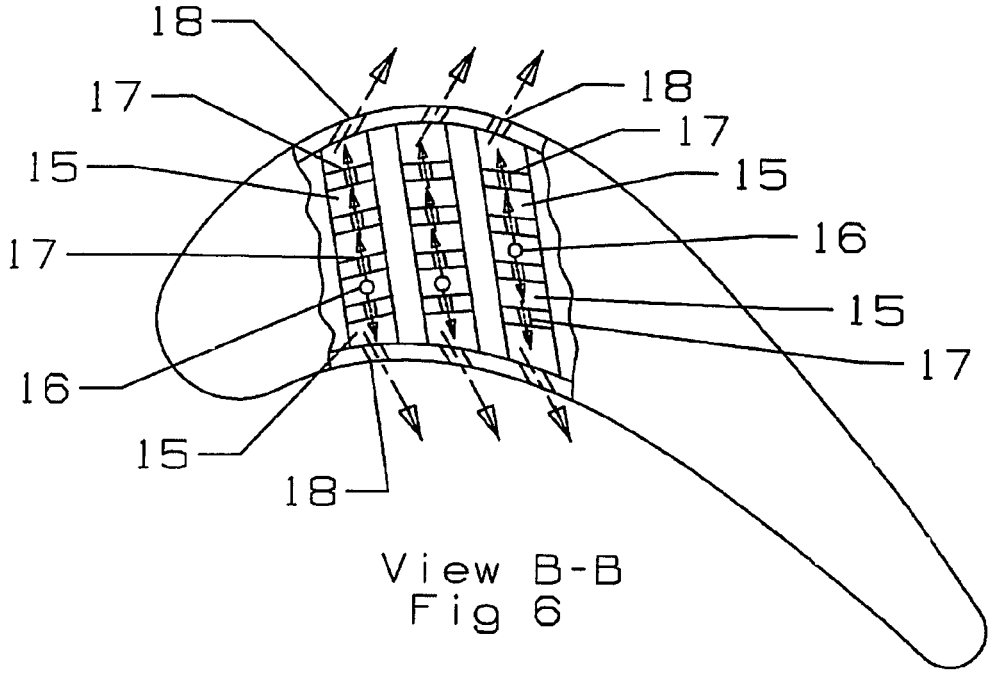
FIG. 6 shows a top view of a cross section of the blade tip cooling circuit of the present invention.
Figure 7:
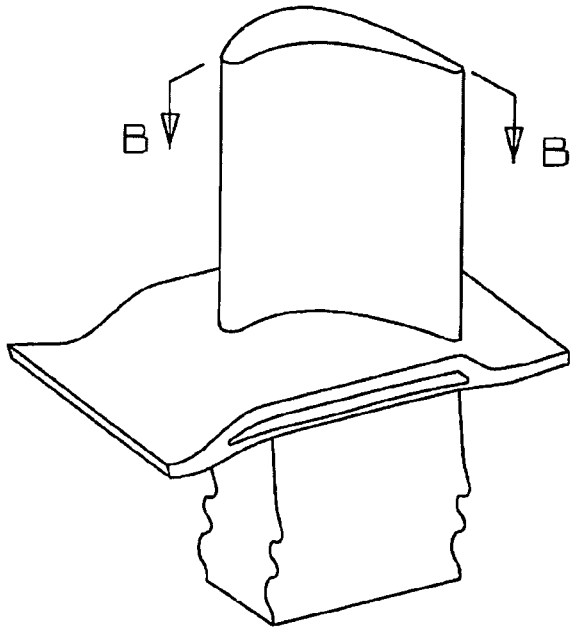
FIG. 7 shows a turbine blade with the view of FIG. 6 shown by the arrows.

FIG. 6 shows a top view of the multiple impingement cooled squealer tip in which several rows of the multiple impingement cavities shown in FIG. 4 extend across the blade tip from the pressure side wall to the suction side wall. In FIG. 6, three of these multiple impingement cavities are shown, each having one of the cavities connected by a main impingement cooling hole 16 to the internal cooling passage 13.

In each of these multiple impingement cavities, five impingement cavities 15 extend from the pressure side wall 11 to the suction side wall 12. On the squealer tip of the blade, these rows of impingement cavities extend from the leading edge region to the trailing edge region to provide cooling for the squealer tip. The airfoil can include a serpentine flow cooling passage in which the rows of impingement cavities can be connected to different legs of the serpentine flow passages. A leading edge cooling supply channel can be located in the leading edge to supply a shower head arrangement of cooling holes for the leading edge. Also, a trailing edge region can be cooling by a row of exit holes arranged along the trailing edge and supplied by a last leg of the serpentine circuit or a separated cooling supply channel adjacent to the trailing edge exit holes.

On the forward most rows of multiple impingement cavities, the second impingement cavity 15 from the pressure side wall is connected to the internal cooling passage 13 through a cooling feed hole 16. this forward-most row includes the main impingement cavity, one pressure side impingement cavity and three suction side impingement cavities all connected with each other through the impingement holes 17. The impingement cavities adjacent to the airfoil walls are connected with film cooling holes 18 to discharge the cooling air onto the airfoil external tip surface.

The second row of multiple impingement cavities is similar to the forward row in that the second impingement cavity from the pressure side wall is connected to the internal cooling passage 13 through the main impingement cooling hole 16. This second row includes main impingement cavity, one pressure side impingement cavity and three suction side impingement cavities all connected with each other through the impingement holes 17. The third row of multiple impingement cavities includes a main impingement cavity in the middle with two pressure side impingement cavity and two suction side impingement cavities all connected with each other through the impingement holes 17. The impingement cavities adjacent to the airfoil walls are connected to the external wall surface by the film cooling holes 18.

The impingement cavity 15 that is connected to the internal cooling supply 13 is considered to be the main impingement cavity in the row of impingement cavities that form the multiple impingement cavities. The impingement cavities located on the pressure side wall of the main impingement cavity is considered to be the pressure side impingement cavities. The impingement cavities located on the suction side wall, of the main impingement cavity is considered to be the suction side impingement cavities. A row of multiple impingement cavities can have one or two pressure side impingement cavities with the rest being formed as suction side impingement cavities. On the pressure side of the squealer tip, a shorter series of the multiple impingement cavities is used. While a higher pressure gradient is available for the suction side of the blade squealer tip, a longer series of multiple impingement cavities is utilized. With this new cooling construction design, the usage of cooling air for a given airfoil inlet gas temperature and pressure profile is maximized.

The multiple impingement cavities, main impingement holes and secondary impingement holes and the rest of the squealer tip cooling circuit can all be formed with the airfoil during the casting process. The individual impingement cavities, the main impingement holes, the secondary impingement holes and the film cooling holes can all be sized according to the cooling air pressure and flow desired in order to regulate the metal temperature and the film cooling air discharged.

In operation, pressurized cooling air is delivered to the internal cooling passage 13 and metered through main impingement cooling holes 16 and into the respective main impingement cooling cavity 15 to be impinged onto the backside of the squealer tip floor 14. The spent cooling air is then metered through the secondary impingement holes 17 and into the adjacent impingement cavity toward the pressure side wall and the suction side wall. the cooling air supplied to the main impingement cavity through the main impingement cooling hole 16 thus flows through the series of secondary impingement holes 17 and pressure side or suction side impingement cavities until being discharged out through the film cooling holes located in the last impingement cavity in the series of multiple impingement cavities along the particular row that extends between the pressure side wall and the suction side wall.

As the cooling air passes through the secondary metering and impingement holes 17, the cooling air flow creates a pair of sidewall vortices within each of the impingement cavities 15. This newly formed sidewall vortices cooling air is repeated in the series of impingement cavities toward the blade outer edge while swirling around in the impingement cavity. The high velocity at the outer periphery of the impingement cavity generates a high rate of internal convection heat transfer coefficient and thus provides for a high cooling effectiveness for the blade squealer tip. The mixing of the pair of sidewall vortices cooling air within the impingement cavity produces a uniform through-wall metal temperature for the blade tip section.

The repeating impingement process allows for the cooling air to diffuse uniformly into the last impingement cavity and thus reduces the cooling air exit momentum. Coolant penetration into the gas path is thus minimized. This yields good buildup of the coolant sub-boundary layer next to the airfoil surface and a better film coverage in the stream-wise direction for the airfoil tip edge.

In addition to a better control of coolant flow and enhanced tip edge cooling, the multiple usage of cooling air in the small individual diffusion modules enhance the airfoil tip section internal convection capability and reduce the cooling flow requirement.

I claim the following:

1. A turbine blade for use in a gas turbine engine, the blade comprising:

A pressure side wall and a suction side wall;

An internal cooling passage located between the two side walls;

A blade tip;

A first row of impingement cavities formed under the blade tip and extending from the pressure side wall to the suction side wall;

Adjacent impingement cavities being connected to each other by a secondary metering and impingement hole;

The impingement cavity adjacent to the pressure side wall being connected to a pressure side film cooling hole;

The impingement cavity adjacent to the suction side wall being connected to a suction side film cooling hole; and, One of the impingement cavities in the first row being connected to a first main metering and impingement hole to the internal cooling passage.

2. The turbine blade of claim 1 and further comprising:

A second row of impingement cavities adjacent to the first row;

The second row including a main impingement cavity connected to the internal cooling passage through a second main metering and impingement hole;

A second pressure side impingement cavity with a second pressure side film cooling hole connected to the second main impingement cavity through a secondary metering and impingement hole; and, A second suction side impingement cavity with a second pressure side film cooling hole connected to the second main impingement cavity through a secondary metering and impingement hole.

3. The turbine blade of claim 2 and further comprising:

The main metering and impingement holes and the secondary metering and impingement holes are sized to regulate the cooling air pressure and flow in order to control the blade tip metal temperature.

4. The turbine blade of claim 1 and further comprising:

A plurality of rows of impingement cavities each extending across the blade tip from the pressure side wall to the suction side wall;

Each of the plurality of rows of impingement cavities having a main impingement cavity connected to the internal cooling passage through a main metering and impingement hole;

Each of the plurality of rows of impingement cavities being connected by secondary metering and impingement holes; and, Each of the impingement cavities located adjacent to the pressure side wall and the suction side wall connected to a film cooling hole.

5. The turbine blade of claim 4 and further comprising:

The main metering and impingement holes and the secondary metering an impingement holes are sized to regulate the cooling air pressure and flow in order to control the blade tip metal temperature.

6. The turbine blade of claim 4 and further comprising:

Some of the rows of impingement cavities have less pressure side impingement cavities that suction side impingement cavities in that particular row.

7. The turbine blade of claim 4 and further comprising:

Only the main impingement cavity in a row of impingement cavities is connected to the internal cooling passage.

8. The turbine blade of claim 4 and further comprising:

The secondary metering and impingement holes are aligned to create sidewall vortices within the impingement cavity.

9. The turbine blade of claim 4 and further comprising:

The blade tip is a squealer tip.

* * * * *